US009638181B2

(12) United States Patent
Mueller et al.

(10) Patent No.: US 9,638,181 B2
(45) Date of Patent: May 2, 2017

(54) VACUUM PUMP FOR APPLICATIONS IN VACUUM PACKAGING MACHINES

(75) Inventors: Didier Mueller, Delemont (CH); Theodore Iltchev, Grandvillars (FR); Stephane Varrin, Coeuve (CH); Philippe Schwob, Roppentzwiller (FR)

(73) Assignee: ATELIERS BUSCH SA, Chevenez (CH)

( * ) Notice: Subject to any disclaimer, the term of this patent is extended or adjusted under 35 U.S.C. 154(b) by 311 days.

(21) Appl. No.: 13/992,285

(22) PCT Filed: Sep. 7, 2011

(86) PCT No.: PCT/EP2011/065443

§ 371 (c)(1),
(2), (4) Date: Jun. 7, 2013

(87) PCT Pub. No.: WO2012/076204

PCT Pub. Date: Jun. 14, 2012

(65) Prior Publication Data

US 2013/0259717 A1 Oct. 3, 2013

(30) Foreign Application Priority Data

Dec. 10, 2010 (CH) ..... 2067/10

(51) Int. Cl.
*F04C 25/02* (2006.01)
*F04B 17/00* (2006.01)
(Continued)

(52) U.S. Cl.
CPC ..... *F04B 17/00* (2013.01); *F01C 21/10* (2013.01); *F04C 18/16* (2013.01); *F04C 25/02* (2013.01);
(Continued)

(58) Field of Classification Search
CPC ..... F04B 17/00; F04B 18/16; F04C 25/02; F04C 25/22403; F01C 21/007; F01C 21/10; B65B 31/021
See application file for complete search history.

(56) References Cited

U.S. PATENT DOCUMENTS 5,807,075 A * 9/1998 Jacobsen et al. ..... 417/44.2
5,904,473 A * 5/1999 Dahmlos et al. ..... 417/410.4
(Continued)

FOREIGN PATENT DOCUMENTS

DE 19749572 5/1999
DE 102008063133 7/2010
(Continued)

OTHER PUBLICATIONS

International Search Report dated Nov. 22, 2012 in corresponding PCT application PCT/EP2011/065443.

*Primary Examiner* — Devon Kramer
*Assistant Examiner* — Kenneth J Hansen
(74) *Attorney, Agent, or Firm* — Abel Law Group, LLP

(57) ABSTRACT

A vacuum pump includes a cylinder. The cylinder includes an inner casing forming two transversely intersected, parallel cylindrical chambers, the axes of which rest in one plane, and one of the faces of which represents a wall on which a suction hole inlet is located. The cylinder also includes an outer casing disposed around the inner casing to form a confined space, provided with the inlet and an outlet, which allows a liquid to be circulated. Two pump rotors are situated in the parallel cylindrical chambers and are driven in rotation by an electric motor. A drive housing contains the motor and components for driving and synchronizing the pump rotors supporting the rotors by cantilever and serving as support and centering with respect to the cylinder. The drive housing includes two extended supports that are integrally constructed as one piece. First and second guide elements
(Continued)

Figure 1:
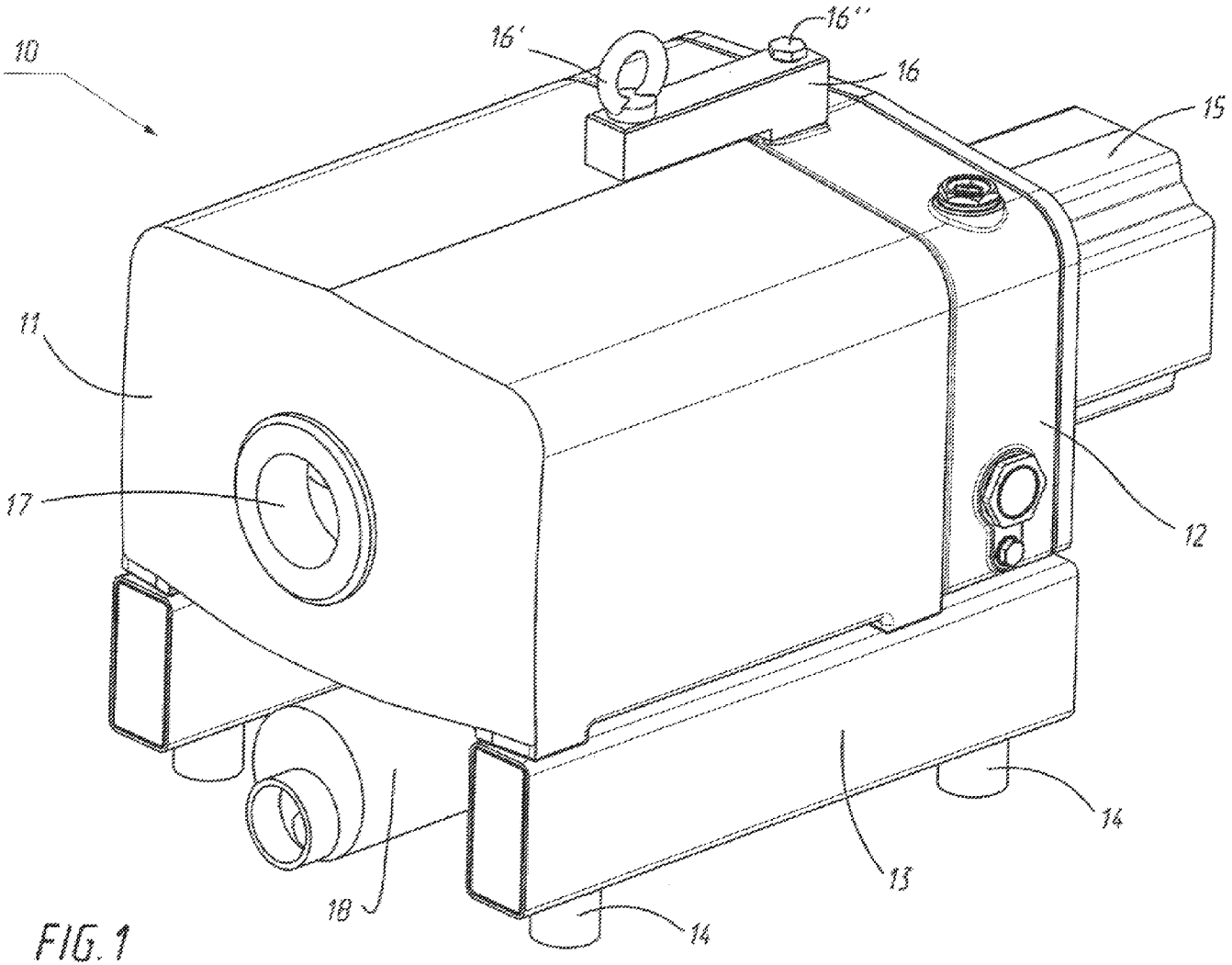

guide rotation of the rotors, which guide elements support the rotors by cantilever, wherein the first guide elements are situated at the ends of the two extended supports.

14 Claims, 3 Drawing Sheets

(51) Int. Cl.

| | |
|---|---|
| ***F01C 21/10*** | (2006.01) |
| ***F04C 18/16*** | (2006.01) |
| *B65B 31/02* | (2006.01) |
| *F01C 21/00* | (2006.01) |

(52) U.S. Cl.
CPC ..... *B65B 31/021* (2013.01); *F01C 21/007* (2013.01); *F04C 2240/51* (2013.01)

(56) References Cited

U.S. PATENT DOCUMENTS

| | | | | |
|---|---|---|---|---|
| 2006/0127245 | A1 | 6/2006 | Ohmi et al. | |
| 2006/0243520 | A1* | 11/2006 | Hertenstein et al. | 181/229 |
| 2007/0104587 | A1* | 5/2007 | Kawamura | C23C 16/4412 417/32 |
| 2009/0269231 | A1* | 10/2009 | Birch | F04C 25/02 418/1 |
| 2010/0135837 | A1* | 6/2010 | Goepfert | F04C 2/086 418/83 |

FOREIGN PATENT DOCUMENTS

| | | | | |
|---|---|---|---|---|
| EP | 1681469 | | 7/2006 | |
| WO | WO 2007022798 | A1 * | 3/2007 | F04C 2/086 |

* cited by examiner

VACUUM PUMP FOR APPLICATIONS IN VACUUM PACKAGING MACHINES

RELATED APPLICATION

This application is a 371 of international application PCT/EP2011/065443, filed Sep. 7, 2011, and claims priority from CH application 02067/10, filed Dec. 10, 2010, which is incorporated herein by reference in its entirety.

TECHNICAL FIELD

This invention relates to the field of vacuum packaging machines (for example chamber machines, thermoformers or tray sealers). More specifically, this invention relates to vacuum pumps used in these machines.

BACKGROUND ART

Vacuum packaging machines are used today in a multiplicity of industrial fields. The reason is that the oxygen contained in the air has detrimental effects on the quality and preservation of products. This is therefore the reason why certain industrial processes, for example the packaging of products, are carried out in a partial or total vacuum. The packaging of products in a vacuum thus significantly reduces the possibility of their deterioration under the influence of the air.

In particular, the industries which often turn to vacuum packaging are the food industry, the cosmetic industry and the pharmaceutical industry because these industries are obliged to guarantee at all times that their products reach the consumer in a perfect state.

Consequently the vacuum packaging machines must necessarily include a vacuum source. This vacuum source (which is typically a vacuum pump) evacuates the air contained in the packaging before it is sealed. In one type of application, a modified atmosphere is injected into the packaging before it is sealed. This method is very often used in the food industry (in particular for the packaging of fresh meat) because it makes it possible to preserve the original form of the food and at the same time keep its fresh appearance, appreciated by the customers, even after a very long period of preservation.

A number of types of machines allowing vacuum packages to be produced are commonly used today. These different types of machines are distinguished in particular by the type of packaging produced, the desired structure or desired application.

One type of vacuum packaging machine which is currently widespread, in particular in the food industry, is known by the name of "tray sealer".

A tray sealer is typically integrated in an assembly for packaging food products in trays in a plastic material or in other suitable receptacles. In such an assembly, a "train of trays" advances step by step on a belt or another similar device in a filling station in which a predetermined amount of the product is deposited in each tray. Afterwards the belt with the trays continues its path towards the tray sealer in which the trays are hermetically sealed with a protective foil before being stocked for transport and sale.

Depending upon the applications, the trays can be put under vacuum and/or filled with a gas mixture (known by the name of "modified atmosphere" or MAP) before being tray-sealed.

The "thermoformers" are another type of vacuum packaging machines. Since the thermoformers are used rather often in the packaging of medicines (tablets, pills, lozenges, etc.) in the form of blisters, they are also called "blister packaging machines."

A thermoformer is essentially a machine which allows pieces to be made by deformation of a plastic sheet. To this end, an electrical resistance is typically foreseen to heat a plastic sheet until it becomes soft. Then a mould is used to give the desired shape to the plastic before it is cooled and extracted from the machine.

Finally, the machines called "chamber machines" work on the basis of bags of plastic material. They are very widespread in the food industry, but also find application in the packaging of other products of mass consumption, surgical instruments or similar items. In a first step, the bags are filled with the product to be packaged. Then the bags are positioned in the working chamber which is closed off by a bell before the vacuum is achieved in the bag through evacuation of the working chamber. In certain applications, a controlled atmosphere is created in the bag. Finally, each bag is sealed by thermal welding.

Of course other types of vacuum packaging machines exist which can be distinguished from these three outlined types by the type of package used.

Coming back to the different vacuum sources in these machines, central vacuum installations have been known for a long time, notably for groups of vacuum packaging machines. Such central vacuum installations necessarily make use of a network of pipes which transport the air between the packaging and the central source. Rather often these central vacuum installations comprise a multitude of vacuum chambers and reservoirs which are connected to different stages of pressure, of which each stage contains another level of pressure.

These central vacuum installations typically have large capacities, and have in particular the advantage of being able to "feed" a plurality of machines at the same time. However, their network of pipes, reservoirs and chambers is costly, very cumbersome for maintaining the desired capacity of pumping, and also very difficult to clean.

Also known is groups of pumps made up of one or more primary pumps and boosters. Typically, the primary pumps are situated outside the vacuum packaging machine, usually for reasons of congestion, in order then to be connected by a pipe to the machine. The valves of the separations and of other auxiliary elements are likewise provided in such an installation in order to enable realisation of the vacuum sought. As a general rule, the control of all the different pumps in a group of pumps of this type is achieved by means of automatic control.

The groups of pumps of this type also have the problems connected with cumbersomeness or congestion and cleaning, but it is moreover necessary to ensure the control of the different elements of the system in an optimal way, which can create problems at the level of synchronisation and/or adjustment.

Also known are the solutions in which a vacuum pump is incorporated into the housing of the vacuum packaging machine, and is directly connected to the part of the machine which must be put under vacuum. Although advantageous at the level of connection of the pump, this arrangement clearly has the disadvantage of being limited only to pumps with certain predetermined dimensions. In other words, the choice of pumps is inevitably limited, and it is thus sometimes difficult or even impossible to find a pump having the necessary features that goes well with the shape and the structure of the packaging machine.

On the other hand, the single pumps and the primary pumps in groups of pumps are in the vast majority of applications vacuum pumps of the lubricated slide vane rotary type. The operating principle of this type of pump poses the problem of drainage of fluids which is intrinsically connected to the nature of the process of pumping. This implies personnel, down times of the installations, but also the consumption of oil and its reprocessing. The operating costs are thereby directly affected.

Moreover there are great risks of contamination upstream from the products to be packaged from the oil coming from a slide vane rotary vacuum pump. This poses a problem in particular in the applications in which the items to be packaged are food or pharmaceutical products which must fulfill certain predefined hygienic standards. The damage can be sizeable considering the rate of an automated vacuum packaging machine. This necessitates a specific and fine monitoring.

Recent applications in the food industry are known where the pumps used are not lubricated slide vane rotary vacuum pumps, but are dry vacuum pumps of the screw type. These pumps originate from standard industrial pumps already proposed by the manufacturers on the market with however slight adaptations connected to the standards of the food industry.

These standards of the food industry notably call for the keeping of elevated levels of hygiene which require a regular cleaning as well as a regular disinfection of the pumps. Nevertheless access to the pump rotors of these pumps is often difficult and takes place by way of total disassembly of the pump, rendering the cleaning problematic. Likewise, the assembly of the different pieces of the pump after the cleaning also proves difficult owing to the problems of precise centring and adjustment of the rotors, which normally requires the intervention of specialized personnel.

Moreover, manufacturers continually want to reduce the cumbersomeness of the components in their manufacturing installations, and in particular in the vacuum packaging machines where the space in the plane of conveyance of the products to be packaged is restricted. At the same time they require of the pumping devices that they always perform better in terms of output and energy consumption.

DISCLOSURE OF INVENTION

The object of the present invention is thus to avoid all the aforementioned drawbacks and to provide a new vacuum pump which is particularly adapted to be used for applications in vacuum packaging machines. In particular, the object of the present invention aims at making available a new vacuum pump that combines a reduced volume with improved performance and whose structure makes possible an easy disassembly, cleaning and reassembly not requiring highly specialised personnel.

To this end, the invention has as its subject matter a vacuum pump according to claim 1.

In particular, the objects assigned to the invention are achieved with the aid of a vacuum pump for applications in vacuum packaging machines comprising:

- a cylinder, made up of
  - the casing of two transversely intersected, parallel cylindrical chambers, the axes of which rest in one plane, and one of the faces of which represents a wall on which the suction hole is located, and
  - the outer casing containing the casing of two parallel cylindrical chambers to form a confined space, provided with an inlet and an outlet, which allows a liquid to be circulated, carrying out the thermal exchange,
- two pump rotors, situated in the parallel cylindrical chambers and driven in rotation by a motor, and
- a drive housing containing the motor and the components for driving and synchronizing the pump rotors supporting said rotors by cantilever and serving as support and centring with respect to the cylinder.

In a special embodiment, the rear part of the housing represents a closed box, including the stator of the electric motor. In particular this box can comprise the control electronics for the electric motor, display means for the parameters of operation of the pump and cooling means. The advantage of this structure is that the components connected to the motor can be separated from the active part of the pump, which makes possible easier control, but also easier handling and easier maintenance.

In another embodiment of the present invention, the motor is supported by cantilever and the rotor of the motor is directly connected to the shaft of one of the pump rotors. This embodiment notably has the advantage that the cumbersomeness of the pump can be reduced. Likewise, a direct contact between the rotor of the motor and the shaft of the pump rotor ensures driving with higher performance.

Furthermore, the motor in the pump according to another embodiment of the present invention has its own bearings, and the rotor of the motor is connected to the shaft of one of the pump rotors by a coupling device. The advantage of this embodiment is the fact that a "conventional" motor can be used. Also, the fact that this motor is supported by its own bearings makes its integration in the pump easier. Also, the replacement of the motor (for example in the case of a malfunction) can be carried out more easily than with a motor that is connected directly to the shaft of the pump rotor.

In another embodiment of the pump according to the invention, the pump comprises a support achieving the connection to the ground or floor, connecting the cylinder in such a way that the flow of pumped gases and of rinsing fluids follows a natural course to the discharge orifice, producing a sound absorbing effect. In a notable way, the support can form an integral part of the outer casing of the cylinder while keeping all its functions. This has the advantage of ensuring an easier manufacturing and of reducing the number of components of the pump.

In notable way, according to another embodiment of the present invention, the plane in which the axes of the cylindrical chambers of the pump lie is horizontal. The advantage of this arrangement is a compact configuration that makes it possible to considerably reduce the cumbersomeness and the use of space. Also, the cleaning and/or the maintenance of the pump can be achieved in a much simpler way since the rotors can be accessed more easily and since the effluents and/or the cleaning means can flow without coming into contact with the other elements of the pump.

Likewise, the suction hole in a special embodiment of the present invention is located in the face of the cylinder opposite the drive housing or the face of the cylinder parallel to the upper face of the support. This positioning of the suction hole is advantageous notably by the fact that the cumbersomeness of the pump can be reduced further. Given that the suction hole is found on one of the most exposed faces, an easy connection to the gas line of the machine can be achieved. It likewise follows from this that this structure allows a direct connection (that is to say solely with the pipes permitting a natural flow of the gas to be evacuated). An improvement in the performance of the pump is a direct consequence thereof.

In the pump according to another embodiment of the present invention, the pump rotors have first and second elements for guiding the rotors in rotation, which guide elements support the rotors by cantilever. As will be explained further below, this structure allows an easy disassembly and an easy putting back in place of the cylinder, not at all affecting the good functioning and control of the rotors.

In a notable way, the pump rotors are of screw type with left-handed thread and right-handed thread respectively, turning meshed together in opposite direction in the cylinder. The advantage of this type of dry pumps is the absence of oil, which makes them able to be used more easily in applications which require an elevated level of hygiene. A contamination can thereby be completely excluded. Also, these pumps are compact and have a good general output. Finally, the control of the speed of rotation can affect in a simple way the adjustment of the output and/or of the level of vacuum.

In a preferred embodiment of the present invention, the first elements for guiding in rotation are situated at the ends of two extended supports which are integral with the drive housing, while the second elements for guiding in rotation are incorporated directly in the drive housing. In this way the support by cantilever can be achieved in a simple way. When the cylinder is taken off to allow access to the rotors (for example for cleaning), the support by cantilever by the elements for guiding in rotation has the result that the setting of the rotors is not changed. Thus the disassembly and the putting back in place of the elements of the pump according to the present invention can likewise be carried out by non-specialized personnel.

Finally, the elements for guiding in rotation can be ball bearings. Ball bearings are mechanical elements which have a lot of advantageous features in this type of applications. Moreover, they are relatively inexpensive.

Figure 2:
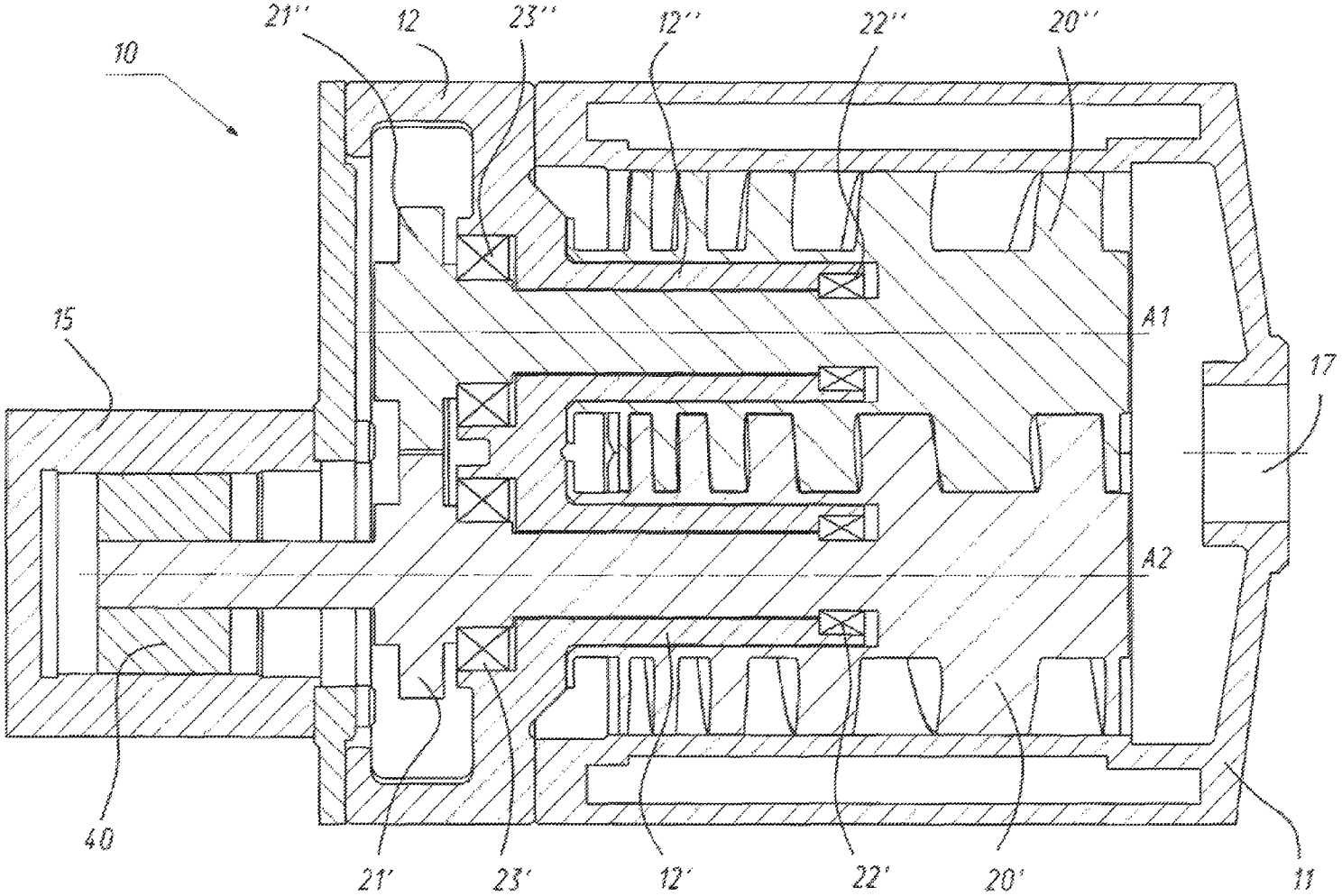
Figure 3:
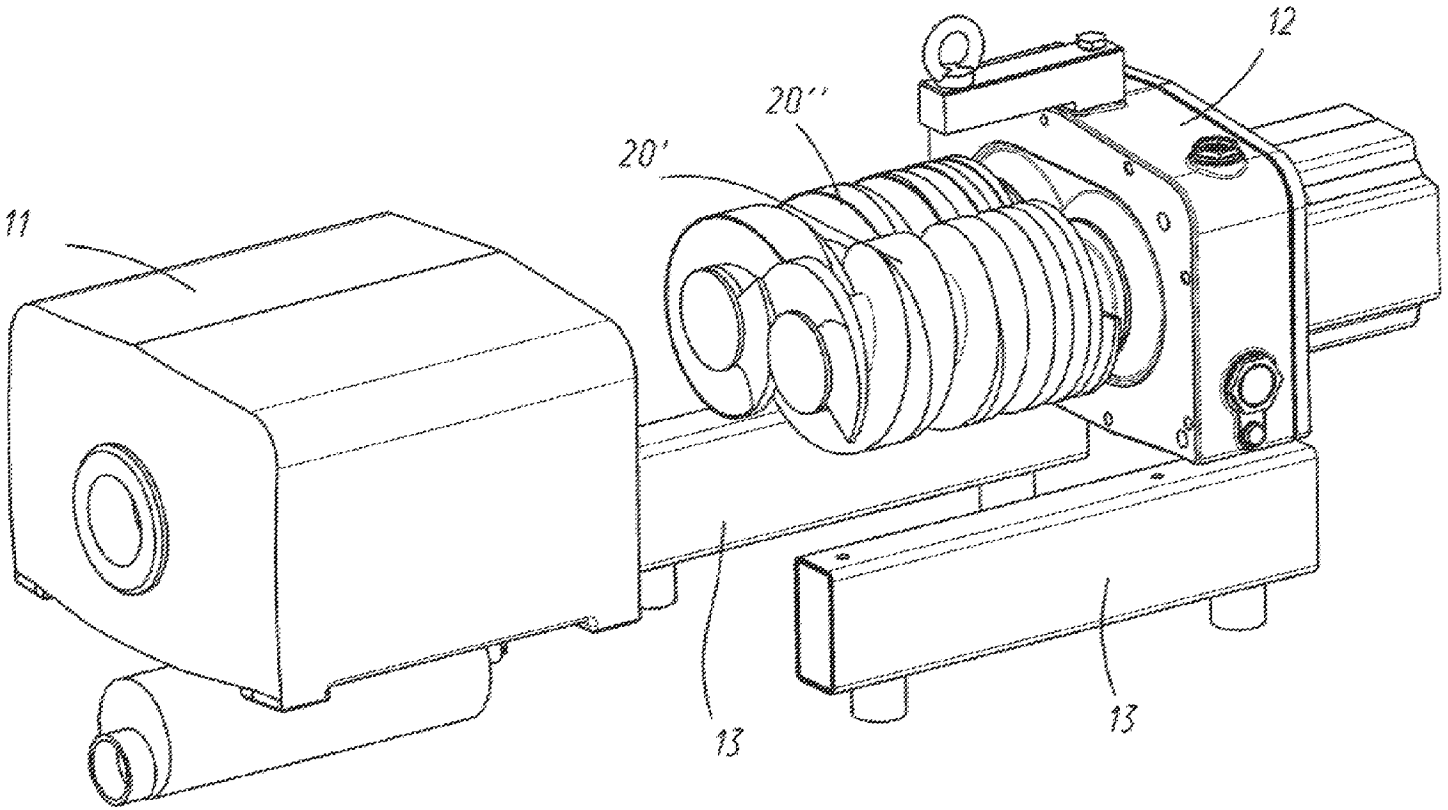

The invention will be well understood from reading the following description, given by way of non-limiting example, with reference to the attached drawings which represent schematically:

FIG. 1: a perspective view of the vacuum pump according to one embodiment of the present invention;

FIG. 2: a sectional view of the vacuum pump of FIG. 1 along a plane which passes through the longitudinal axes of the rotors;

FIG. 3: a perspective view of the vacuum pump of FIG. 1 with the cylinder separated from the drive housing and from the base.

DETAILED DESCRIPTION OF THE INVENTION

Represented schematically in FIG. 1 is a vacuum pump 10 according to a preferred embodiment of the present invention. As already mentioned further above, this vacuum pump 10 is intended in particular for applications in vacuum packaging machines. Nevertheless, it must be noted that the area of applications of the vacuum pump 10 is not limited to this single application. One skilled in the art thus easily understands that this vacuum pump 10 can also be used favourably in other applications.

In response to market trends and to avoid the mentioned drawbacks, this vacuum pump 10 has a specific configuration.

In particular, the body of the pump 10 comprises a cylinder 11 which encloses the "active" part of the vacuum pump 10, in particular the two pump rotors which enable creation of a vacuum by means of a process known in the art. These pump rotors are arranged in transversely intersected parallel cylindrical chambers, the axes of which rest in one plane. In FIG. 1, the plane in which the axes of the pump rotors rest is horizontal. However, it is likewise possible to imagine a pump which has all the other features of the pump according to FIG. 2, but whose plane in which the axes of the pump rotors rest is inclined by a certain angle with respect to the horizontal plane or even a pump whose pump rotors are arranged vertically or at a certain angle with respect to the vertical plane. The rotors can notably be of the screw type with variable pitch with respectively left-handed thread and right-handed thread, turning meshed together in opposite direction in the cylinder 11 (all the details of this structure of the rotors will be shown in detail further on). Of course the present invention is in no way limited to screws with variable pitch, and it is completely conceivable to use screws with constant pitch (on a single portion or on the whole length of the screw, for example a screw "with stages" with a first zone having a first constant pitch and at least one second zone having a second constant pitch, different from the first pitch, or a screw with a first zone having a constant pitch and a second zone having a variable pitch) while keeping all the advantages of the present invention.

As regards the cylinder 11, it comprises, on the one hand, an inner casing and, on the other hand, an outer casing. The inner casing of the cylinder 11 encloses the two parallel cylindrical chambers that contain the rotors. The outer casing of the cylinder 11, for its part, encloses the inner casing to form a confined space, provided with an inlet and an outlet, which thus allow a liquid to be circulated, carrying out the thermal exchange. The cylinder 11 is provided with an inlet for gases to be pumped 17 and an outlet for gases 18.

The cylinder 11 rests against a drive housing 12. This drive housing 12 contains, among other things, the various components for driving and for synchronizing the rotors, which components support these rotors by cantilever and which serve as support and centring with respect to the cylinder 11, as will be shown in more detail later.

Also, provided on the upper part of the housing 12 is a suspension arrangement 16. This suspension arrangement 16 comprises a ring 16' to which a hook (or another similar device) can be attached to lift the pump 10 with the aid of a lifting machine, for example in order to install the pump 10 at a good location during the initial installation phase or during service and maintenance periods. The suspension arrangement 16 is typically fixed to the housing 12 with the aid of one or more screws 16" which allow the suspension arrangement to be removed if it is not being used, but it is clear that it is possible to conceive of a pump 10 in which the suspension arrangement 16 cannot be taken off or even a pump 10 which does not have a suspension arrangement.

In FIG. 1, the rear part of the housing 12 is enlarged towards a closed box 15, which includes the stator of the electric motor. This electric motor drives in rotation the two above-mentioned pump rotors, which are located in the chambers enclosed by the cylinder 11. In addition, the box 15 can likewise include the control electronics of the electric motor, display means for the parameters of operation of the pump 10 and/or cooling means, but these elements can also be accommodated in dedicated boxes or in other parts of the vacuum pump 10.

Preferably, the rotor of this electric motor is also supported by cantilever and is directly connected to the shaft of one of the pump rotors which bears one of the screws (as will be illustrated in more detail in FIGS. 2 and 3). Thus, the rotation of the rotor 40 of the electric motor is directly transmitted to the first pump rotor, and, thanks to a suitable transmission mechanism (for example a gearing), to the second pump rotor of the pump. However, the motor used can also be a "conventional" motor, supported by its own bearings, the rotor of which is connected to the shaft of one of the pump rotors by a suitable coupling device.

In these two configurations, the motors used can be synchronous motors (brushless or other) or indeed asynchronous or induction motors or any other type. The advantage of using an asynchronous motor lies in particular in the fact that it can be directly connected to the electric network. On the other hand, synchronous motors notably have the advantage of being more compact. Use of a synchronous motor thus makes it possible to advantageously reduce the cumbersomeness of the pump according to the present invention. Moreover synchronous motors are also more economical, and they include an integrated control which makes possible a simple adjustment of the speed of rotation depending upon the desired application.

The reference numeral 13 in FIG. 1 represents a support or a base which achieves the connection to the ground or floor for the cylinder 11. For this purpose, the support 13 has feet 14 which can be made in particular of a soft material, different from the material of the support 13, for example of caoutchouc or the like. These feet 14 can be fixed, but also adjustable in such a way as to be able to compensate for any unevenness of the ground or floor. The number of feet 14 can also vary depending upon the concrete needs.

In another embodiment of the vacuum pump 10 according to the present invention, the support 13 can form an integral part of the outer casing of the cylinder 11 while keeping all its functions.

FIG. 2 represents a sectional view of the vacuum pump 10 of FIG. 1 along a plane which passes through the longitudinal axes of the rotors. As can be seen in FIG. 2, the plane which contains the axes of the pump rotors is a horizontal plane. Nevertheless, as mentioned further above, the axes of the pump rotors can also be located in a vertical plane or a plane inclined with respect to the horizontal plane and/or with respect to the vertical plane.

In FIG. 2, it can be seen that the pump 10 is a dry pump of the screw type with two pump rotors 20', 20". Using another type of pump rotors with a similar configuration is not excluded, however. The two pump rotors 20', 20" are enclosed by the cylinder 11, and they are driven in rotation about their longitudinal axes A1, A2 by the electric motor 40, which is accommodated in the drive box 15. This electric motor is directly connected to a first pump rotor 20', and the driving force is then transmitted to the second pump rotor 20" through a suitable transmission mechanism 21', 21" in such a way as to allow a synchronized rotation, but in opposite direction, of the two rotors 20', 20".

The pump rotors 20', 20" in FIG. 2 are of screw type. The screws 20', 20" are respectively with left-handed thread and right-handed thread, and they are guided in rotation about their longitudinal axes A1, A2 by the first elements for guiding in rotation 22', 22" and the second elements for guiding in rotation 23', 23". The first 22', 22" and second 23', 23" elements for guiding in rotation of the rotors 20', 20" can be in particular ball bearings. It is however possible to use another type of element for guiding in rotation to attain the same aims.

In the region of the two axes of rotation of the rotors A1, A2, the drive housing 12 extends to form a first extended support 12' and a second extended support 12". It is precisely these two supports 12', 12" which bear at their ends the first elements for guiding in rotation 22', 22" which, with the second elements for guiding in rotation 23', 23", support the rotors 20', 20".

The structure of the elements for guiding in rotation 22', 22", 23', 23", which is represented in FIG. 2, enables in particular rotors 20', 20" to be obtained that are supported by cantilever by the drive housing 12. In other words, the rotors 20', 20" are not supported on the side of the inlet 17 which is located on the cylinder 11.

This particular structure thus makes it possible to disassemble the pump 10 and afterwards to put all the elements back in place in a very easy way. FIG. 3 shows a perspective view of the vacuum pump 10 with the cylinder separated from the drive housing and from the base. In FIG. 3, the cylinder 11 of the body of the pump 10 has been separated completely from the drive housing 12 and from the base 13. Such a separation of the cylinder 11 is necessary in particular for cleaning of the rotors 20' and 20" of the pump 10. Owing to the support by cantilever of the rotors 20', 20" by the elements for guiding in rotation 22', 22", 23', 23", the cylinder 11 can be easily lifted from the base 13, without the rotors 20', 20" having been touched. As the two supports 12', 12" are only integral with the drive housing 12, the absence of the cylinder 11 does not have any effect upon the rotors 20', 20", which can easily remain fixed, centred and balanced in their initial position. In other words, an adjustment of the rotors 20', 20" is not necessary for putting the pump 10 back into operation.

We would like to remind you again here that the use of vacuum pumps in vacuum packaging machines for the food industry must not be contrary to food standards. The pump 10 according to the invention is a dry pump, and it thus eliminates completely the possibility of contamination of foodstuffs by oil. Also, compared with the lubricated slide vane rotary vacuum pump, the draining and the treatment of the oils are likewise eliminated, which makes use of such a pump easier.

Also, the food standards require a regular disassembly of the pump for cleaning, service or inspection. Owing to the proposed structure, the disassembly does not have to be carried out by specialized personnel.

The vacuum pump 10 for applications in vacuum packaging machines according to the present invention thus has several advantages which help improve the use and the operation of a vacuum packaging machine with respect to the following aspects:

1. Saving electrical energy:
   - in relation to a predefined cycle time owing to the nature of the pumping process (rate of internal compression and variation of pitch along the screw);
   - through use of a synchronous motor coupled to its control electronics (the rotor motor mounted by cantilever on the shaft);
   - through the variation of the speed of rotation of the rotors depending upon the requirements of the vacuum packaging machine;
2. Saving space:
   - by using a single pump instead of commonly used pumping means and in particular instead of either a lubricated slide vane rotary vacuum pump, integrated in the vacuum packaging machine, or a pumping group, composed of a lubricated slide vane rotary pump, situated at a distance from the vacuum packaging machine, and a pump of the Roots type, integrated in the vacuum packaging machine;

by an advantageous positioning of the axes of the pump rotors;

by a particularly compact design, compared with pumps currently used, which design is connected to, among other things, the speed of rotation of the rotors, higher than the nominal speeds of asynchronous motors, but also to the absence of a compartment for bearings or for gears on the suction side;

3. Elimination of the risk of internal contamination of the products to be packaged by the oil coming from the vacuum pump:

by using a dry vacuum pump of the screw type;

through the absence of a compartment containing lubricant (compartment for bearings or for gears) on the suction side;

4. Saving oil through elimination of oil changes connected with the slide vane rotary pump;

5. Saving time during cleaning and maintenance procedures:

through an outer form for the pump specially engineered to meet the standards of hygiene for food packaging;

through an easiness of disassembly of the pump and of access to the rotors without the necessity of draining oil from the housing for the driving pinions and without upsetting the functional play;

through access from a single side for all maintenance operations.

It is clear to one skilled in the art that the information which has been given concerning a vacuum pump can be easily adapted and/or supplemented with the aid of other elements well known in the field without these adaptations and/or supplements going beyond the scope of the present invention.

The invention claimed is:

1. Vacuum pump for applications in vacuum packaging machines, comprising:

a cylinder, including an inner casing forming two transversely intersected, parallel cylindrical chambers, the axes of which rest in one horizontal plane, and one of the faces of which represents a wall on which a suction hole inlet is located, and an outer casing disposed around said inner casing to form a confined space, which allows a liquid to be circulated, carrying out thermal exchange, said outer casing being provided with said suction hole inlet and an outlet, wherein said cylinder is integrally formed of one piece, an electric motor, two pump rotors including screw portions, said pump rotors being situated such that said screw portions are completely contained in the parallel cylindrical chambers and driven in rotation by said motor, each of said pump rotors including a central opening, a drive housing containing components for driving and synchronizing said pump rotors supporting said rotors by cantilever and serving as support and centering with respect to the cylinder, said drive housing including the following integral construction: two extended supports and a mounting surface, said two extended supports being tubular and disposed in said central openings of said pump rotors, first guide elements and second guide elements for guiding rotation of the rotors, the first and second guide elements support the rotors by cantilever, wherein said first guide elements are situated at the ends of said two extended supports and said second guide elements are incorporated in said drive housing, and wherein said cylinder rests against and is fastened to said mounting surface of said drive housing.

2. Pump according to claim 1, wherein a rear part of said drive housing forms a closed box, including a stator of said electric motor.

3. Pump according to claim 1, wherein one of said pump rotors includes a shaft, said electric motor is supported by cantilever and includes a motor rotor, and said motor rotor is directly connected to said shaft of one of the pump rotors.

4. Pump according to claim 1, wherein one of said pump rotors includes a shaft, said electric motor includes a motor rotor, said electric motor includes bearings and said motor rotor is connected to the shaft of one of the pump rotors by a coupling device.

5. Pump according to claim 1, wherein the suction hole inlet is located in a face of the cylinder opposite the drive housing.

6. Pump according to claim 1, wherein the pump rotors include left-handed thread and right-handed thread respectively, turning meshed together in opposite direction in the cylinder.

7. Pump according to claim 1, wherein the first and second guide elements for guiding in rotation are ball bearings.

8. Vacuum pump for applications in vacuum packaging machines, comprising:

a casing extending between a first end and a second end and forming a confined space, wherein said first end includes a suction hole inlet, and said casing includes a passageway adapted for flow of cooling liquid and an outlet;

two horizontally extending pump rotors including screw portions, said pump rotors being situated adjacent to each other in parallel such that said screw portions are completely contained inside said casing, a drive shaft extending from one of said pump rotors, said pump rotors including central openings;

an electric motor that engages only said drive shaft of one of said pump rotors near the second end of said casing so as to directly rotate only said one pump rotor;

gearing enabling said direct rotation of said one rotor to rotate said other rotor;

a drive housing containing said gearing and said drive shaft near the second end of said casing, said drive housing including the following integral construction: two, spaced apart tubular supports that extend in parallel inside said central openings of said pump rotors, and a mounting surface, said casing resting against and being fastened to said mounting surface of said drive housing; and first guide elements and second guide elements for guiding rotation of the pump rotors, the first and second guide elements support said pump rotors by cantilever, wherein said first and second guide elements are situated at respective ends of said two tubular supports.

9. Pump according to claim 8, wherein said second guide elements for guiding in rotation are incorporated in said drive housing.

10. Pump according to claim 8, wherein said first and second guide elements for guiding in rotation are ball bearings.

11. Pump according to claim 8, wherein said pump rotors include left-handed thread and right-handed thread respectively, turning meshed together in opposite direction in said casing.

12. Pump according to claim 8 wherein said outlet includes a discharge orifice extending below and being vertically spaced from said casing, and a support connected to said casing for mounting on a ground or floor surface, whereby a flow of pumped gases during pumping or a flow of rinsing liquids during cleaning leaves said casing through said discharge orifice towards the ground or floor.

13. Vacuum pump for applications in vacuum packaging machines, comprising:

a cylinder, including an inner casing forming two transversely intersected, parallel cylindrical chambers, the axes of which rest in one horizontal plane, and one of the faces of which represents a wall on which a suction hole inlet is located, and an outer casing disposed around said inner casing to form a confined space, which allows a liquid to be circulated, carrying out thermal exchange, said outer casing being provided with said suction hole inlet, wherein said cylinder is integrally formed of one piece, an electric motor, two pump rotors including screw portions, said pump rotors being situated such that said screw portions are completely contained in the parallel cylindrical chambers and driven in rotation by said motor, each of said pump rotors including a central opening, a drive housing containing components for driving and synchronizing said pump rotors supporting said rotors by cantilever and serving as support and centering with respect to the cylinder, said drive housing including the following integral construction: two extended supports and a mounting surface, said two extended supports being tubular and disposed in said central openings of said pump rotors, first guide elements and second guide elements for guiding rotation of the rotors, the first and second guide elements support the rotors by cantilever, wherein said first guide elements are situated at the ends of said two extended supports and said second guide elements are incorporated in said drive housing, and wherein said cylinder rests against and is fastened to said mounting surface of said drive housing;

a support connected to said cylinder for mounting on a ground or floor surface, a discharge orifice extending below and being vertically spaced from said outer casing, whereby a flow of pumped gases during pumping or a flow of rinsing liquids during cleaning leaves said cylinder through said discharge orifice towards the ground or floor.

14. Pump according to claim 13, wherein said support forms an integral part of said outer casing of the cylinder.

* * * * *